US005228379A

United States Patent [19]

Kawai et al.

[11] Patent Number: 5,228,379

[45] Date of Patent: Jul. 20, 1993

[54] SWASH PLATE TYPE COMPRESSOR

[75] Inventors: Katsunori Kawai; Masaki Nomura; Toshihiro Kawai, all of Kariya, Japan

[73] Assignee: Kabushiki Kaisha Toyoda Jidoshokki Seisakusho, Kariya, Japan

[21] Appl. No.: 782,059

[22] Filed: Oct. 24, 1991

[30] Foreign Application Priority Data

Oct. 26, 1990 [JP] Japan ..... 2-112541[U]

[51] Int. Cl.[5] ..... F01B 3/00

[52] U.S. Cl. ..... 92/71; 417/269; 74/60

[58] Field of Search ..... 92/71, 129, 12.2; 417/269; 74/60; 91/499, 502

[56] References Cited

U.S. PATENT DOCUMENTS 1,517,386 12/1924 Almen ..... 92/138
1,826,325 10/1931 Paul ..... 74/60
3,641,829 2/1972 Reynolds ..... 74/60
5,046,403 9/1991 Riedhammer ..... 92/71

FOREIGN PATENT DOCUMENTS 592577 6/1929 France ..... 92/71
173843 3/1935 Switzerland ..... 92/71

*Primary Examiner*—Thomas E. Denion
*Attorney, Agent, or Firm*—Brooks Haidt Haffner & Delahunty

[57] ABSTRACT

A swash plate type compressor is disclosed which is intended to prevent a hemispherical shoe, provided between the piston and the swash plate, from being spun on slat surface of the swash plate during operation of the compressor. In the preferred embodiment of the invention, the swash plate is formed with a step and the shoe with a cut portion engageable with the step so that the shoe is prevented from being spun on the slant surface of the swash plate which provides a turning moment to the shoe. The step is formed by an annular projection having an annular wall portion defining the inner limit of the slant surface area of the swash plate with which the flat face of the hemispherical shoe is kept in sliding contact, and the cut portion of the shoe has a curved surface conforming to the curvature of the annular wall portion. The shoe is located with its cut portion slidably contactable with the annular wall portion.

6 Claims, 4 Drawing Sheets

SWASH PLATE TYPE COMPRESSOR

FIELD OF THE INVENTION

The present invention relates to a refrigerant compressor of swash plate type wherein a double-headed piston is caused to slide reciprocatingly in a cylinder bore by rotary wobbling motion of a swash plate driven by a drive shaft and engaged with the piston by way of hemispherical shoes. More specifically, the invention relates to an arrangement of the hemispherical shoes and the swash plate for preventing the shoes from being spun on the swash plate during operation of the compressor.

BACKGROUND OF THE INVENTION

Swash plate type refrigerant compressor of a typical structure is disclosed by, e.g., Publication of Unexamined Japanese Patent Application No. 60-209,674 (1985). The compressor of this type includes front and rear cylinder blocks axially combined and having formed therein a plurality of cylinder bores and a center swash plate compartment, a reciprocable double-headed piston received in each of the cylinder bores, a drive shaft rotatably supported in the cylinder block assembly, and a swash plate fixedly mounted on the drive shaft at an inclined angle for rotary wobbling movement in the swash plate compartment. Each piston is held by the swash plate by way of a pair of front and rear hemispherical shoes interposed between the front and rear slant surfaces of the swash plate and shoe receiving recesses formed in the piston at its intermediate portion, respectively, so that the wobbling movement of the swash plate is converted into reciprocating movement of the piston in its associated cylinder bore for compression of refrigerant gas introduced into the cylinder bore.

In operation of the compressor, flat or non-spherical face of the shoe is kept in sliding contact with the slant surface of the rotating swash plate. Since the plate rotates at a higher peripheral speed at a location thereof farther from the axis of the drive shaft, the flat face of the shoe will be subjected to the influence of such different peripheral speeds of the swash plate, which results in a turning moment causing the shoe to be rotated or spun on the slant surface of the plate. If the piston is made of soft material such as aluminum, the shoe receiving recess of the piston tends to wear rapidly by sliding contact with the shoe which is periodically pressed against the recess while spinning. An increase of the wear to such an extent that an excessive clearance is formed between the shoe and the piston will allow noise to be developed by the shoe striking the swash plate and the piston during operation of the compressor. Thus, the conventional swash plate type compressor has had a problem in durability.

SUMMARY OF THE INVENTION

It is an object of the present invention, therefore, to provide a swash plate type refrigerant compressor according to which its shoe is prevented from being spun on the slant surface of the swash plate, thereby restricting the wear in the shoe receiving recess of the piston that would otherwise result in development of striking noise and also in poor durability of the compressor.

According to the present invention, the swash plate and each shoe are provided with locating means, respectively, which are engaged with each other so as to stop the shoe from being spun on the slant surface of the swash plate. In the embodiment of the invention, the locating means of the swash plate includes a stepped portion formed by a projection having an annular wall portion defining the inner limit of the slant surface area of the swash plate with which the flat face of the shoe is set in sliding contact, while the locating means of the shoe includes a cut portion engageable with the annular wall portion of the swash plate. The cut portion of the shoe has a curved surface conforming to the curvature of the annular wall portion and the shoe is arranged in such an orientation that its cut portion is set in slidably contact with the annular wall portion.

DETAILED DESCRIPTION OF THE EMBODIMENTS

Figure 2:
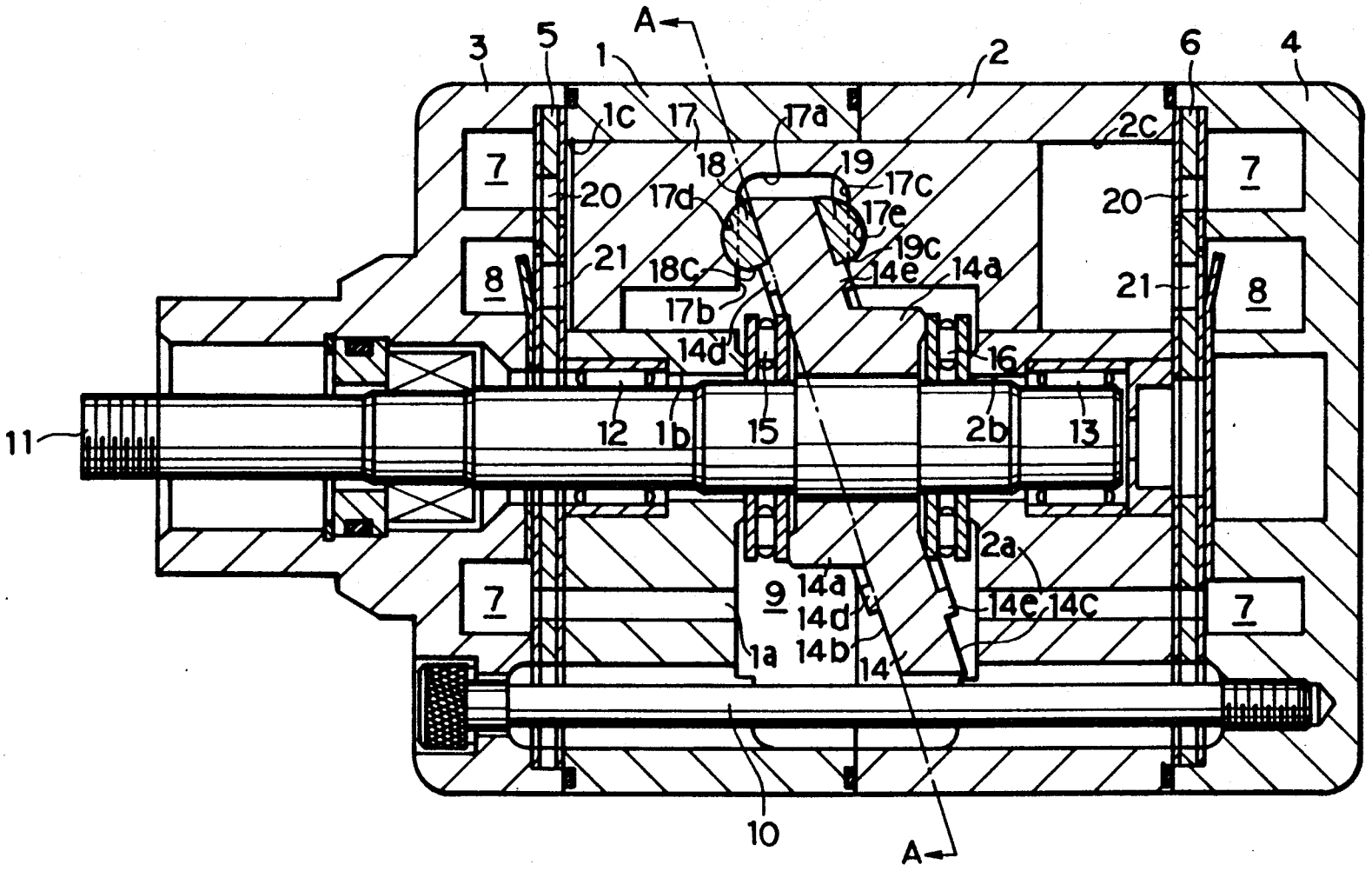
FIG. 2 is a longitudinal section of the swash plate type compressor.

Referring to FIG. 2, there is illustrated a swash plate type refrigerant compressor constructed according to the present invention. The compressor includes front and rear cylinder blocks 1, 2 sealingly combined to each other to form a cylinder block assembly. The cylinder block assembly has at its opposite outer ends front and rear housings 3, 4 sealingly fastened thereto by means of a plurality of bolts 10, with valve plates 5, 6 interposed between the cylinder block assembly and the housings 3, 4, respectively. Each of the front and rear housings 3, 4 has formed therein separate suction and discharge chambers 7, 8. The front and rear cylinder blocks 1, 2 cooperate to define therein a compartment 9 for accommodating a circular swash plate 14 which is fixedly mounted on a drive shaft 11. The drive shaft 11 is received in central axial bores 1*b*, 2*b* formed in the front and rear cylinder blocks 1, 2, respectively, in alignment with each other and supported rotatably by a pair of radial bearings 12, 13 pressed in the axial bores 1*b*, 2*b*. The swash plate 10 is fixed at its boss portion 14*a* on the swash plate 14 at a predetermined angle of inclination so that the plate makes a wobbling movement in the compartment 9 when it is driven to rotate by the drive shaft 11. As seen in the drawing, a pair of thrust bearings 15, 16 are installed on the drive shaft 11 between the opposite ends of the boss portion 14*a* and the inner surfaces of the cylinder blocks 1, 2 for axially retaining the drive shaft 11. Both suction chambers 7 in the front and rear housings 3, 4 communicate with the swash plate compartment 9 through suction passages 1*a*, 2*a*, respectively.

Figure 1:
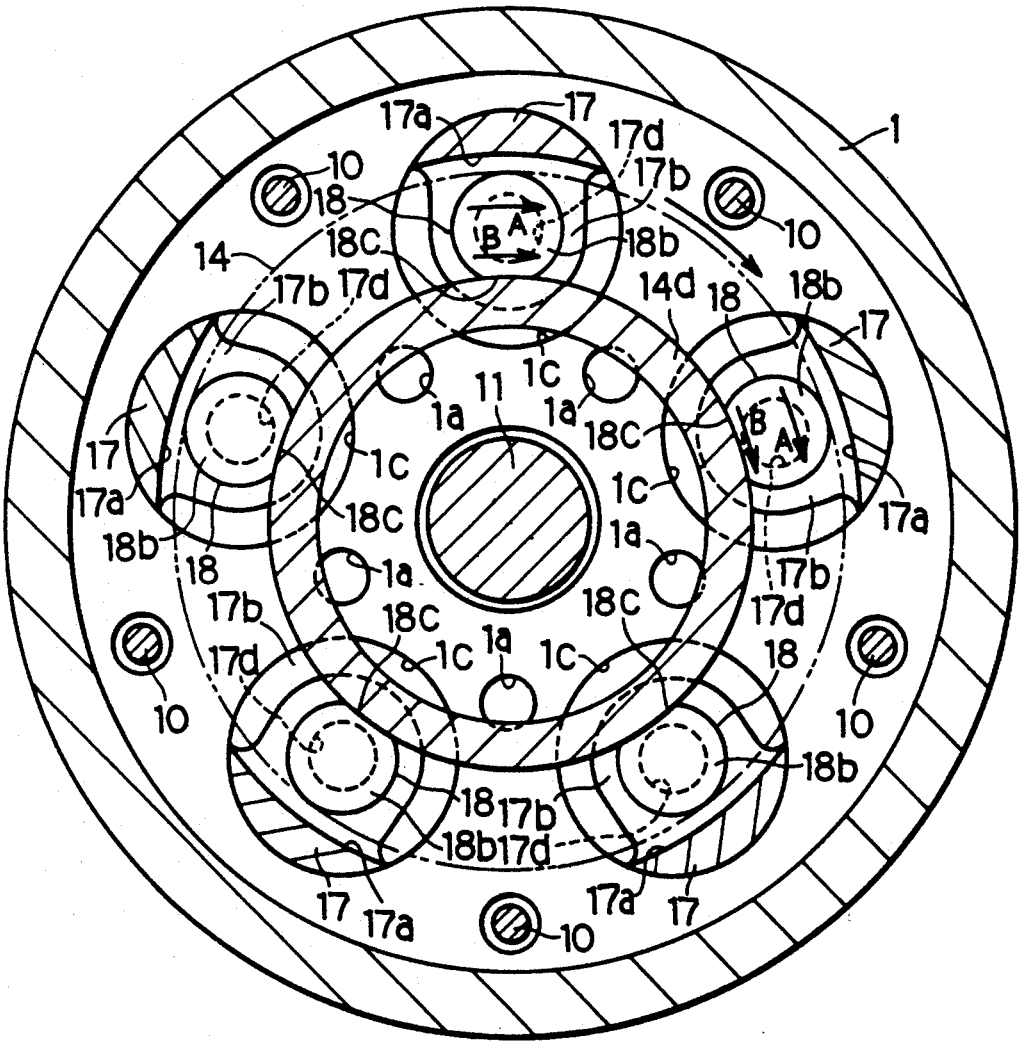
FIG. 1 is a transverse section taken along line A—A of FIG. 2 of a swash plate type refrigerant compressor constructed according to the present invention.

The cylinder block assembly has formed therein a desired number of cylinder bores 1*c*, 2*c*, namely five bores in the illustrated embodiment as clearly shown in FIG. 1, which are equally angularly spaced around and in parallel with the drive shaft 11. Each cylinder bore receives therein a double-headed piston 17 mounted for reciprocal axial sliding movement in the bore. Each piston 17 is held to the swash plate 14 by way of a pair of front and rear shoes 18, 19, which will be described in detail in later part hereof, in such a way that the wobbling movement of the swash plate 4 is converted into the reciprocal axial sliding movement of the piston 17 in its corresponding cylinder bore. Each of the front and rear valve plates 5, 6 has formed therein a suction port 20 providing communication between the suction chamber 7 and the cylinder bore and a discharge port 21 communicating between the discharge chamber 8 and the cylinder bore.

The following will describe the manner in which the hemispherical shoes 18, 19 are fitted between the swash plate 14 and the pistons 17.

Figure 3:
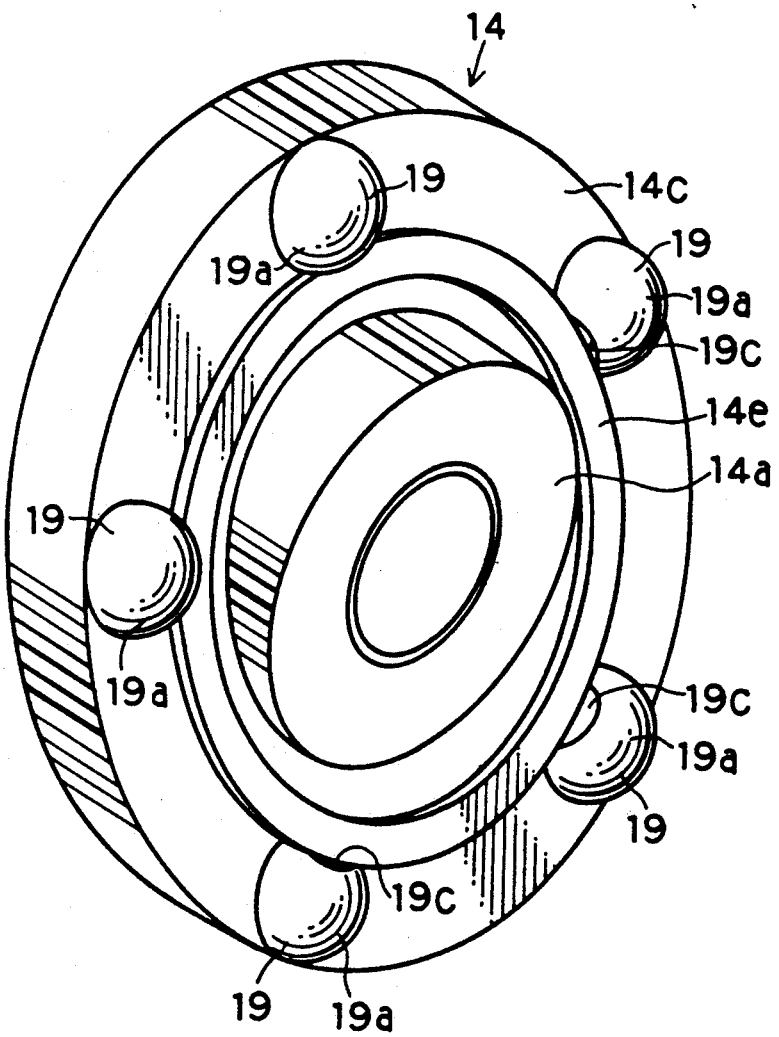
FIG. 3 is a perspective view showing the arrangement of a swash plate and shoes of the compressor.

Each piston 17 is formed at its center between the opposite heads with an inwardly opened cavity 17*a* into which part of the outer peripheral portion of the circular swash plate 14 may be received. The cavity 17*a* has opposite front and rear faces 17*b*, 17*c* on which shoe receiving recesses 17*d*, 17*e* are formed each having a contour conforming to the hemispherical shape of the shoes 18, 19. The front shoe 18 is fitted between the swash plate 14 and the piston 17 with the hemispherical face 18*a* thereof received in the shoe receiving recess 17*d* and the flat face 18*b* placed in sliding contact with front slant surface 14*b* of the swash plate. The rear shoe 19 is similarly fitted with its hemispherical face 19*a* received in the shoe receiving recess 17*e* in the piston 17 and the flat face 19*b* set in sliding contact with rear slant surface 14*c* of the swash plate. As shown in FIGS. 2 and 3, the slant surfaces 14*b*, 14*c* of the swash plate 14 are formed by providing a step so that the outer peripheral portion of the plate is reduced in thickness and annular projections 14*d*, 14*e* each having an annular wall portion facing outwardly are formed on opposite front and rear sides of the swash plate 14. Each of the shoes 18, 19 is formed, at part of its edge defined between the spherical and flat faces thereof, with a cut 18*c* or 19*c* having a curved surface conforming to the curvature of the wall portion of the corresponding annular projection 14*d* or 14*e*. As shown in the drawings, the shoe is located in such orientation that its cut 18*c* or 19*c* is set in slidable contact with the wall portion of the annular projection 14*d* or 14*e* so that spinning of the shoe on the slant surface of the swash plate 14 is restricted by such contact engagement between the shoe and the swash plate.

The following will describe the operation of the above-described swash plate type compressor.

While the swash plate 14 is being driven to rotate by the drive shaft 11, it makes a wobbling movement thereby to impart a reciprocating motion to the double-headed pistons 17 in the shoes 18, 19. In one cycle of the reciprocating motion of each piston, refrigerant gas is drawn from the suction chamber 7 through the inlet port 20 in the valve plate 5 or 6 into the cylinder bore 1*c* or 2*c*, compressed in the cylinder bore, and then discharged out into the discharge chambers through the discharge pot 21.

During rotation of the swash plate 14, each shoe is subjected to a turning effort of the swash plate tending to cause the shoe to be spun on the slant surface of the plate due to difference of surface speeds in relative sliding movement between the slant surface and the shoe, as indicated by comparison between arrows "A" and "B" (FIG. 1) wherein "A" is located farther than "B" as measured from the axial center of the drive shaft and, therefore, the surface speed is higher at "A" than at "B". In the above embodiment, however, the shoes 18, 19, which are engaged at their cut portions 18*c*, 19*c* with the wall portion of the annular projections 14*d*, 14*e*, can be prevented successfully from being spun on the slant surfaces 14*b*, 14*c*. Thus, excessive sliding contact between the shoes 18, 19 and the shoe receiving recesses 17*c*, 17*e* of the pistons 17 can be forestalled, with the result that wear of the recesses can be restricted and, therefore, development of striking noise due to excessive clearance between the shoes and the pistons caused by the wear can be prevented. Additionally, durability of the pistons 17 can be improved.

Figure 4:
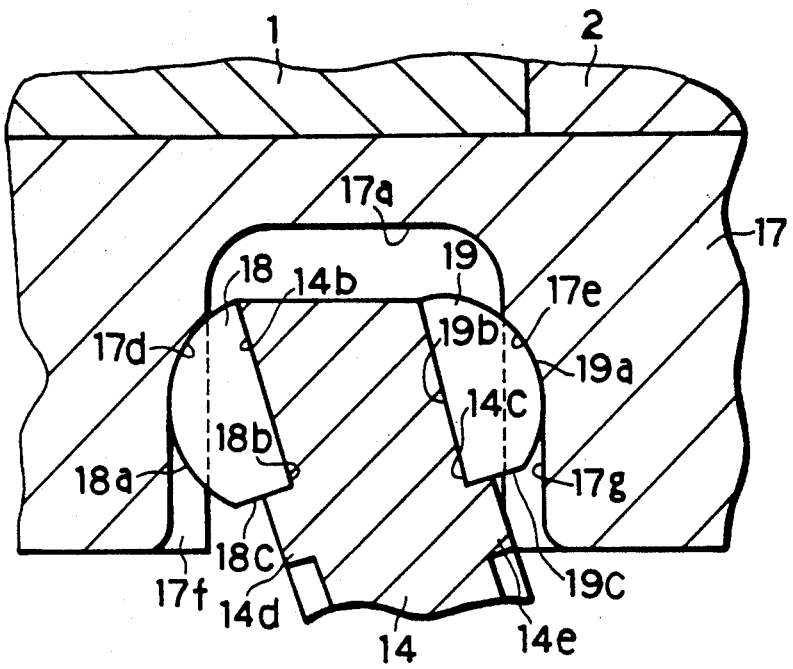
FIG. 4 is a fragmental enlarged sectional view showing the arrangement of piston, shoes and swash plate in a modified embodiment of the present invention.
Figure 5:
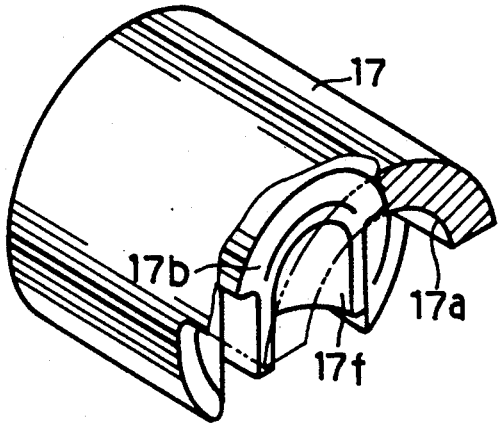
FIG. 5 is a fragmental perspective view of the piston in the modified embodiment of FIG. 4.

The following will describe a modified second embodiment in accordance with the present invention while having reference to FIGS. 4 and 5.

This second embodiment differs from the above first embodiment in that the shoe receiving recesses 17*d*, 17*e* of the piston 17 in the first embodiment are substituted by shoe receiving grooves 17*f*, 17*g*. The outer part of the respective shoe receiving grooves 17*f*, 17*g*, as viewed with reference to the axial center of the drive shaft, has a curved surface conforming to the hemispherical face 18*a*, 19*a* of the shoe and the inner part thereof is open to the swash plate compartment and has a cross section of a segment of a circle. As compared with the first embodiment wherein the shoe receiving recesses 17*d*, 17*e* would have to be formed by additional machining, the grooves 17*f*, 17*g* in the second embodiment can be formed integrally with other parts of the piston 17 in the phase of shaping of the piston, e.g. by forging, without applying additional machining. Therefore, as-forged strength is obtained for shoe receiving grooves 17*f*, 17*g*, thus contributing to the strength improvement of the piston.

While the invention has been described and illustrated specifically with reference to the desired embodiment and other possible modifications, it is to be understood that the invention can be changed or modified in various other ways without departing from the spirit or scope thereof.

What is claimed is:

1. A swash plate type refrigerant compressor comprising a pair of axially combined front and rear cylinder blocks cooperating to form therein a center compartment for accommodating therein a circular and substantially unitary swash plate and a plurality of axially extending cylinder bores for receiving therein reciprocally slidable pistons, a drive shaft rotatably supported in said combined cylinder blocks and extending axially through said compartment, said swash plate being fixedly mounted on said drive shaft at an inclined angle so as to make a wobbling movement when driven to rotate by the drive shaft, each of said pistons having a cavity to receive the outer peripheral portion of said circular swash plate, each said piston being held by said swash plate by way of a shoe having substantially hemispherical shape with a hemispherical face and a flat face and fitted with its hemispherical face received in a shoe receiving recess formed on a face of said cavity in the piston and its flat face placed in annular sliding contact with the swash plate, whereby the wobbling movement of the swash plate is converted into reciprocal axial sliding movement of each said piston in its corresponding cylinder bore, said swash plate and each of said shoes having locating means, respectively, which are engaged with each other for preventing each said shoe from being spun the swash plate.

2. A swash plate type refrigerant compressor according to claim 1, wherein said locating means of the swash plate includes an annular step formed on each side of the swash plate and said locating means of said each shoe includes a cut portion engaged with said annular step.

3. A swash plate type refrigerant compressor according claim 2, wherein said step is formed by an annular projection having an annular wall portion facing outwardly and defining an inner limit of a slant surface area of the swash plate with which said flat faces of the hemispherical shoes are set in sliding contact.

4. A swash plate type refrigerant compressor according to claim 3, wherein said cut portion of the shoe has a curved surface conforming to the curvature of said annular wall portion and the shoe is arranged with its cut portion in sliding contact with the annular wall portion.

5. A swash plate type refrigerant compressor according to claim 1, wherein said shoe receiving recess is formed with a contour conforming to the hemispherical shape of the shoe.

6. A swash plate type refrigerant compressor according to claim 5, wherein said contour of the shoe receiving recess includes a groove having a cross section of a segment of a circle and extending toward said swash plate compartment.

* * * * *